US007238888B2

(12) United States Patent
Goto et al.

(10) Patent No.: US 7,238,888 B2
(45) Date of Patent: Jul. 3, 2007

(54) WIRE FOR COIL

(75) Inventors: Yoshihide Goto, Sagae (JP); Katuyosi Oonuma, Sagae (JP); Kenji Morooka, Sagae (JP); Hirotaka Sato, Sagae (JP); Tadashi Oshikiri, Sagae (JP); Taiki Goto, Sagae (JP)

(73) Assignee: Goto Denshi Co., Ltd., Yamagata (JP)

( * ) Notice: Subject to any disclaimer, the term of this patent is extended or adjusted under 35 U.S.C. 154(b) by 174 days.

(21) Appl. No.: 10/964,345

(22) Filed: Oct. 13, 2004

(65) Prior Publication Data

US 2005/0104708 A1 May 19, 2005

(30) Foreign Application Priority Data

Nov. 13, 2003 (JP) ..... P2003-384209

(51) Int. Cl.
*H01B 5/02* (2006.01)
*H01B 5/08* (2006.01)
*H01H 27/28* (2006.01)

(52) U.S. Cl. ..... 174/129 R; 336/225; 174/133 R

(58) Field of Classification Search ..... 174/129 R, 174/133 R; 336/225
See application file for complete search history.

(56) References Cited

FOREIGN PATENT DOCUMENTS

| | | |
|---|---|---|
| DE | 198 18040 | 11/1999 |
| JP | 62 29011 | 2/1987 |
| JP | 62 141898 | 6/1987 |
| JP | 63-190310 | 8/1988 |
| JP | 1-176315 | 12/1989 |
| JP | 04148823 A * | 5/1992 |
| JP | 2003-317549 | 11/2003 |

* cited by examiner

*Primary Examiner*—Anh Mai
(74) *Attorney, Agent, or Firm*—Ladas & Parry LLP

(57) ABSTRACT

In a coil wire having a square sectional shape, arc-shaped chamfers are provided at four corners in the section of the square. The sectional area of the coil wire having the chamfers is set to at least 1.15 times as large as that of a circle having a diameter which is the same as the length of one side of the square.

8 Claims, 2 Drawing Sheets

WIRE FOR COIL

BACKGROUND OF THE INVENTION

1. Field of the Invention

The present invention relates to a wire for a coil, having a square shape in cross section.

2. Related Art

It is known that most of conventional coil wires have a circular shape in section (hereinbelow, a coil wire having a circular sectional shape will be called a "round wire"). By covering a round wire as a conductor with an insulating layer, a round electric wire is formed. When a coil is manufactured by using such a round wire, naturally, a gap is created between round wires. The coil therefore has a drawback of a low packing factor. It is also known that a coil wire having a conductor whose sectional shape is a square is manufactured to solve the drawback (hereinbelow, a coil wire having a square shape in section will be called "square wire").

However, it is also known that the square wire requires a know-how different from that of the conventional method of forming a round wire with respect to formation of an insulating layer and a winding method for obtaining a coil shape.

For example, the square wire has a drawback that it is difficult to form a uniform insulating layer at four corners in section. We have already proposed a method providing a novel insulating layer, and so on, to solve the drawback, thereby obtaining the insulating layer for which the shape of each corner is stable. We have found that the method produces an effect of improving mass productivity.

Generally, to improve a packing factor, an ideal square is preferable as a sectional shape. Specifically, a shape in which chamfers (including arc-shaped chamfers ("R part") and linear chamfers) are not provided at all at the corners is preferable. In the case where the sectional shape is a perfect square, a wire is wound while sides are closely attached to each other, so that the sides function as a guide.

However, in the case of providing an insulating layer for a perfect square, which is not chamfered, a problem occurs such that the thickness of the insulating layer at the corners varies. For example, in a wire generally called a slit wire obtained by cutting a thin plate made of a conductive material and having a predetermined thickness into parts each having a predetermined width by slitter, the corners are not chamfered, but a small burr which is disadvantageous to form an insulating film occurs. In the case of providing an insulating layer for a square wire as the slit line, the thickness of the insulating layer in the corner varies, as mentioned above. Naturally, it is not preferable as a coil wire. In addition, in the case of providing an insulating layer, in a square wire having no chamfers at corners, a phenomenon tends to occur that the insulating layer is destroyed in a position at which a layer lies on another layer in a winding process, for example, in a position at which the second layer lies on the first layer.

Since the corners of the square wire are not chamfered, the corners easily come into engagement with each other. On the other hand, in the case where the corners are chamfered, if the dimension of the chamfer is too large, a so-called rolling phenomenon occurs in the winding process. As a result, the packing factor becomes lower than that of the round wire, and the performance deteriorates.

SUMMARY OF THE INVENTION

The invention relates to improvement in a coil wire having a square sectional shape, and its object is to provide a coil wire by which a higher-performance and higher-quality coil can be obtained at a price almost equal to that of a conventional round wire.

The invention according to claim 1 relates to a coil wire having a square sectional shape, wherein chamfers are provided at four corners in the section of the square, and sectional area of said wire having the chamfers is at least 1.15 times as large as that of a circle having a diameter which is the same as the length of one side of said square.

The invention according to claim 2 relates to a coil wire having a square sectional shape, wherein arc-shaped chamfers are provided at four corners in the section of the square, and length of the radius of an arc of said arc-shaped chamfer is set so that the sectional area of said wire having said chamfers is at least 1.15 times as large as that of a circle having a diameter which is the same as the length of one side of said square.

The invention according to claim 3 relates to a coil wire having a square sectional shape, wherein chamfers are provided at four corners in the section of the square, and overall length of an outer circumference of the section of said wire having said chamfers is at least 1.09 times as long as circumference of a circle having a diameter which is the same as the length of one side of said square.

The invention according to claim 4 relates to a coil wire having a square sectional shape, wherein arc-shaped chamfers are provided at four corners in the section of the square, and length of the radius of an arc of said arc-shaped chamfer is set so that overall length of an outer circumference of the section of said wire having said chamfers is at least 1.09 times as long as circumference of a circle having a diameter which is the same as the length of one side of said square.

In the invention according to one of claims 1 to 4, length of one side of said square may be 1 mm or less.

According to the invention, the following advantageous effects are produced.

By forming a sectional shape in which chamfers of dimensions optimized for the length of one side of a square are provided at four corners in a cross section of a square wire, variations in the thickness of an insulating layer in the chamfers do not occur, and an uniform insulating layer is stably obtained. No problem occurs also in a winding process, and further, the packing factor improves with reliability as compared with that of a coil using a conventional round wire (hereinbelow, called "round wire coil"). Therefore, the coil having higher performance than that of the round wire coil can be obtained.

In the coil winding structure using the coil wire of the invention, a gap is smaller than that of the round wire coil, so that a heat radiation effect and heat resistance can be improved.

The coil wire of the invention can achieve productivity, which is equivalent to that of a conventional round wire, at an almost same cost.

DESCRIPTION OF THE PREFERRED EMBODIMENTS

Embodiments of the invention will be described hereinbelow with reference to the drawings.

FIGS. 1 to 4 are diagrams each showing a sectional shape according to an embodiment of a coil wire of the invention, a change in a chamfer and changes in the sectional area of the wire and the length of the circumference. FIG. 5 is a diagram showing a square sectional shape of a square wire and a circular sectional shape of a round wire as the base of creation of the wire of the invention.

For explanation, a length D of one side of a square 3 having a square sectional shape as the base of creation of the wire of the invention shown in FIG. 5 is set to 0.3 mm. In the invention, it is desirable to set the length D of one side of the square 3 to 1 mm or less. The diameter D, of a circle 4, having the sectional shape of a round wire is 0.3 mm which is the same as one side of the square 3. The radius R of an arc-shaped chamfer obtained when the square 3 and the circle 4 are overlapped each other is the radius of the circle 4, and is 0.15 mm (D/2).

In FIG. 5, the area A of the circuit 4 is equal to 0.785D*D, the overall length L of the outer circumference is equal to 3.14*D, the area A of the square 3 is equal to D*D (up 27.3% (1.27 times)), and the overall length L of the outer circumference is equal to 4*D (up 27.3% (1.27 times)).

Figure 1:
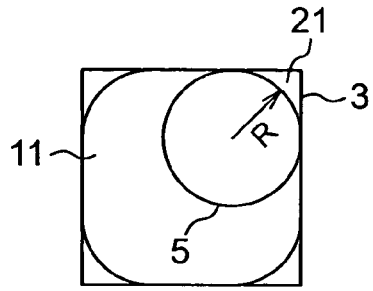
FIG. 1 is a first explanatory diagram showing a change in a chamfer according to an embodiment of the invention, and changes in a sectional area and length of circumference of a cross section of a wire.

As shown in FIG. 1, in a coil wire of the invention (hereinbelow, called "wire of the invention") serving as a conductive part of an electric wire for a coil, an arc-shaped chamfer 21 is provided at each of the four corners in a cross section of a square wire having a square sectional shape and whose one side is D. It is assumed that the area of a sectional shape 11 of the wire of the invention is at least 1.15 times as large as the area of the circle 4, or the overall length of the outer circumference of the sectional shape 11 of the wire of the invention is at least 1.09 times as long as the circumference of the circle 4. An electric wire for a coil is constructed by covering the wire (conductive part) of the invention having such a sectional shape with an insulating layer. The length D of one side of the square 3 is 0.3 mm.

In the case where the sectional shape of the wire of the invention is out of the range of the invention, that is, when the sectional area is less than 1.15 times as large as the area of the circle 4, or the length of the outer circumference is less than 1.09 times as long as the circumference of the circle 4, the yield decreases and, as a result, productivity deteriorates. A so-called rolling phenomenon such that the wire lies out of the range of normal winding occurs in the winding process, and a gap between a wire and a wire becomes larger than that in normal winding of a round wire. The sectional shape of the wire of the invention does not include a complete square. When the sectional shape is a perfect square, problems described in the above item "Related Art" such as variations in the thickness of the insulating layer occur.

In FIG. 1, while the radius of the circle 4 is 0.15 mm, the radius R of the circle 5 constructing an arc of the arc-shaped chamfer 21 is 0.1 mm. The circumference of the circle 5 is in contact with a side of the square 3 at the corners. The area of the arc-shaped chamfer 21 is smaller than that of the arc-shaped chamfer created when the square 3 and the circle 4 shown in FIG. 5 are overlapped with each other. In other words, the area of the sectional shape 11 of the wire of the invention is larger than that of the circle 4. For example, in FIG. 1, the area of the sectional shape 11 is about 1.15 times as large as that of the circle 4 (up 15.1%). As described above, by setting the length of the radius R of the arc (the radius R of the circle 5) of the arc-shaped chamfer 21, the area of the sectional shape 11 of the coil wire can be set to a desired value.

The overall length of the outer circumference of the sectional shape 11 in FIG. 1 is 1.09 times as long as the circumference of the circle 4 (up 9.1%). By setting the length of the radius R of the arc of the arc-shaped chamfer 21 (radius R of the circle 5), the overall length of the outer circumference of the sectional shape 11 can be set to a desired length.

Figure 2:
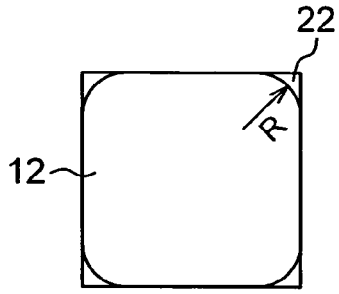
FIG. 2 is a second explanatory diagram showing a change in a chamfer according to the embodiment of the invention, and changes in a sectional area and length of circumference of a cross section of a wire.

In FIG. 2, while the diameter D of the circle 4 is 0.3 mm, the radius R of the arc of the arc-shaped chamfer 22 is 0.06 mm, and the area of the sectional shape 12 is 1.22 times as large as that of the circle 4 (up 22.8%). The overall length of the outer circumference of the sectional shape 12 is 1.16 times as long as the circumference of the circle 4 (up 16.4%).

Figure 3:
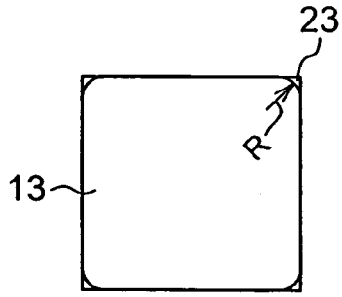
FIG. 3 is a third explanatory diagram showing a change in a chamfer according to the embodiment of the invention, and changes in a sectional area and length of circumference of a cross section of a wire.

In FIG. 3, while the diameter D of the circle 4 is 0.3 mm, the radius R of the arc of the arc-shaped chamfer 23 is 0.03 mm, and the area of the sectional shape 13 is 1.26 times as large as that of the circle 4 (up 26.1%). The overall length of the outer circumference of the sectional shape 13 is 1.21 times as long as the circumference of the circle 4 (up 21.9%).

Figure 4:
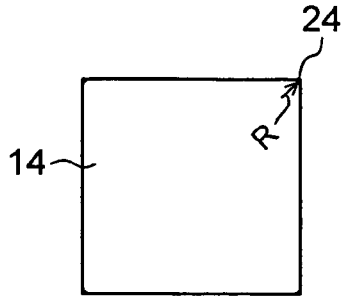
FIG. 4 is a fourth explanatory diagram showing a change in a chamfer according to the embodiment of the invention, and changes in a sectional area and length of circumference of a cross section of wire.
Figure 5:
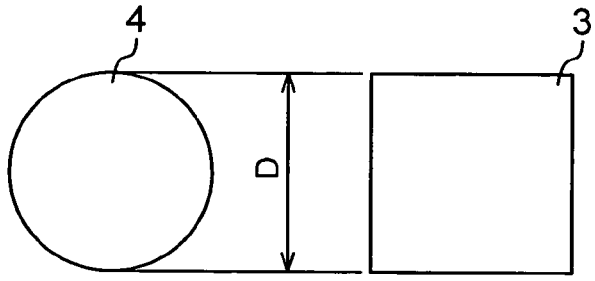
FIG. 5 is an explanatory diagram showing a square sectional shape of a square wire and a circular sectional shape of a round wire as the base of creation of the wire of the invention.

In FIG. 4, while the diameter D of the circle 4 is 0.3 mm, the radius R of the arc of the arc-shaped chamfer 24 is 0.01 mm, and the area of the sectional shape 14 is 1.27 times as large as that of the circle 4 (up 27.1%). The overall length of the outer circumference of the sectional shape 14 is 1.25 times as long as the circumference of the circle 4 (up 25.5%).

Although not shown, the chamfer can take the form of a linear chamfer. In this case as well, it is sufficient to set the area ratio between the sectional shape of the conductive part and the circle 4 or the ratio between the overall length of the outer circumference and the circumference of the circle 4 to be within the range of the invention.

As described above, by improving the sectional shape of the square wire constructing the conductive part of the coil electric wire, and optimizing the dimensions by providing chamfers at four corners in the section of the square, the insulating layer at the corners can be uniformly and stably obtained. Further, the packing factor is certainly improved as compared with that of the conventional round wire coil, so that a coil having higher performance than the round wire coil can be obtained, and stable winding can be performed also in the winding process. The productivity is not disturbed.

Embodiment 1

The invention will be described in more details by examples.

A speaker was manufactured by using a coil wire of the invention, and compared with a speaker manufactured by using a conventional round wire.

The length of one side D of a square sectional shape of a square wire as the base of the invention shown in FIG. 5 was set to 0.16 mm. The square wire was used as a base, a shape shown in FIG. 1 is prepared, that is, the four corners in the square section were chamfered so that the area becomes 1.15 times as large as that of the circle 4 having a diameter (0.16 mm) which is the same as D, or the overall length of the outer circumference of the sectional shape becomes 1.09 times as that of the circle 4. Such chamfered wire (conductive part) of the invention was covered with an insulating layer, thereby preparing the coil electric wire ("Example 1 of the invention"). The length of one side including the chamfer in the sectional shape of the prepared coil electric wire (hereinbelow, called "regular square electric wire") was 0.185 mm. By using the regular square electric wire, a speaker coil (voice coil) having a diameter of about 50 mm, winding width of 5.74 mm, and impedance of 3.5Ω was prepared, and further, a speaker was manufactured by using the voice coil.

In contrast, in Comparative Example 1, a round electric wire was prepared by covering a circular round wire (conductive part) having the same section area as that in Example 1 of the invention with the insulating layer, a round wire coil was produced by using the round electric wire, and concerning other parts, a speaker for comparison was produced by using the same parts as those of the above-described speaker.

The performances of the speakers were compared. The performance comparison was made by comparing output sound pressure level values (dB) in F characteristic measurement by a method similar to that in Example 2 of the invention, which will be described later. As a result, an effect was recognized that the sound pressure of Example 1 of the invention is higher than that of Comparative Example 1 by 0.5 dB.

Embodiment 2

The length of one side D of the sectional shape of the square wire as the base of the invention shown in FIG. 5 was set to 0.16 mm. By using the square wire as a base, the following coil wires were prepared: the coil wire (Example 1 of the invention) shown in FIG. 1 and used in Example 1 of the invention; a coil wire (called "Example 2 of the invention") having chamfers at the four corners shown in FIG. 2 so that the sectional area becomes 1.22 times as large as the area of the circle 4, or the overall length of the outer circumference of the sectional shape becomes 1.16 times as long as the circumference of the circle 4; a coil wire (called "Example 3 of the invention") having chamfers shown in FIG. 3 at the four corners so that the sectional area becomes 1.26 times as large as the area of the circle 4, or the overall length of the outer circumference of the sectional shape becomes 1.21 times as long as the circumference of the circle 4; and a coil wire (called "Example 4 of the invention") shown in FIG. 4 having chamfers at four corners so that the sectional area becomes 1.27 times as large as the area of the circle 4, or the overall length of the outer circumference of the sectional shape becomes 1.25 times as long as the circumference of the circle 4. Each of the prepared coil wires was covered with an insulating layer in a manner similar to Example 1 of the invention, thereby preparing an electric wire for a coil (regular square electric wire). The length of one side including the chamfer in the sectional shape of the prepared regular square electric wire was 0.185 mm. By using the regular square electric wires of Examples 1 to 4 of the invention prepared as described above, in a manner similar to Example 1 of the invention, a coil for a speaker (voice coil) having a diameter of about 50 mm, winding width of 5.74 mm, and impedance of 3.5Ω was manufactured. By using the voice coil, a speaker was manufactured.

In Comparative Example 2, a round electric wire was prepared by covering a round wire in which the diameter of the circle 4 as a sectional shape of the conductive part is set to the same length as one side D (0.16 mm) of the square with an insulating layer. By using the round electric wire, a round wire coil was produced. By using the same parts as those of the above speaker concerning other parts, a speaker for comparison was produced.

Figure 6:
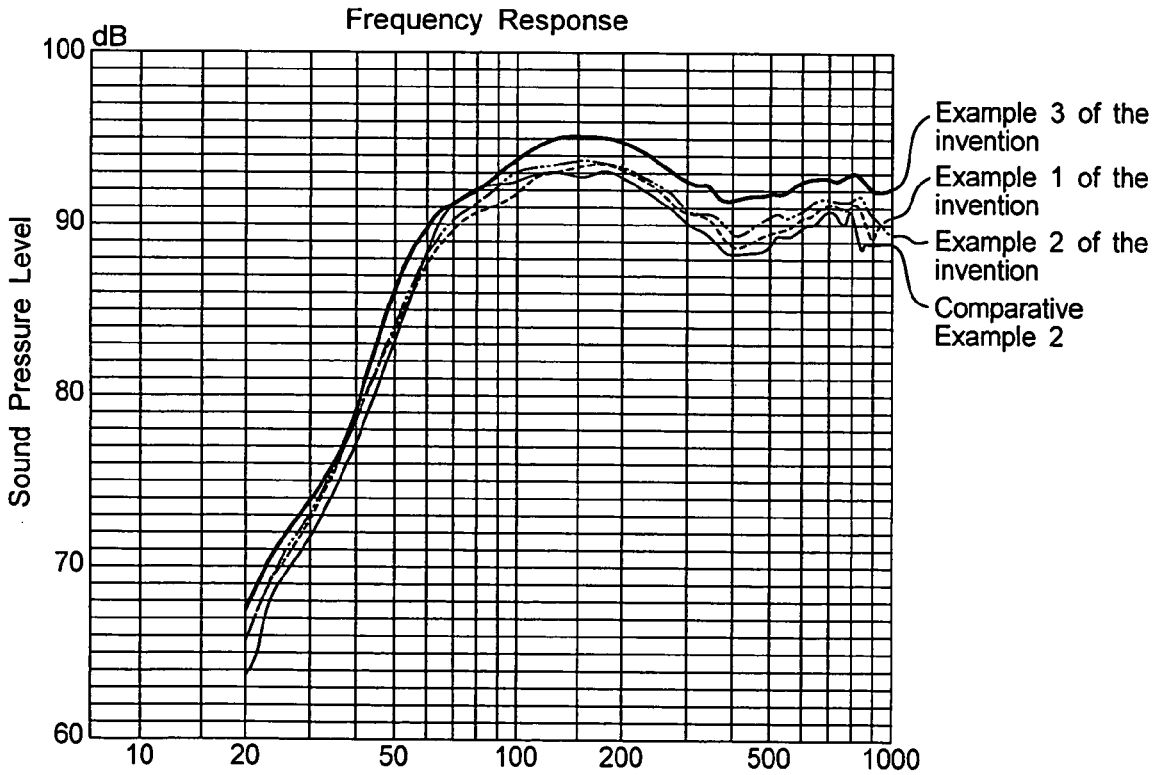
FIG. 6 is a graph showing frequency characteristics by the relation between output sound pressure level and frequency in examples of the invention.

The performances of the speakers were compared. FIG. 6 shows frequency characteristics as the result of comparison, and is a graph showing frequency characteristics by the relation between output sound pressure level and frequency. In FIG. 6, Example 1 of the invention is indicated by a broken line, Example 2 of the invention is indicated by an alternate double-dot-dashed line, Example 3 of the invention is shown by a thick solid line, and Comparative Example 2 is expressed by a thin solid line. The performance comparison was made by comparing output sound pressure level values (dB) in the F characteristic measurement. 300 Hz, 400 Hz, 500 Hz, and 600 Hz in the frequency values in FIG. 6 were set as designated frequencies, and the average value of the output sound pressure level values (dB) at the four frequencies was used as sensitivity of the speaker. By comparing the average values, the performances were compared.

As shown in FIG. 6, the sensitivity of Example 1 of the invention is 89.7 dB, and that of Comparative Example 2 is 89.2 dB. It was confirmed that the sound pressure of Example 1 of the invention is improved by about 0.5 dB as compared with Comparative Example 2.

The sensitivity of Example 2 of the invention is 90.3 dB, and that of Comparative Example 2 is 89.2 dB. It was confirmed that the sound pressure of Example 2 of the invention is improved by about 1.0 dB to 1.5 dB as compared with Comparative Example 2.

The sensitivity of Example 3 of the invention is 92.0 dB, and that of Comparative Example 2 is 89.2 dB. It was confirmed that the sound pressure of Example 3 of the invention is improved by about 2.0 dB to 2.5 dB as compared with Comparative Example 2.

Although the sensitivity of Example 4 of the invention is not shown, it was confirmed that the sound pressure is improved by about 2.5 dB to 3.0 dB as compared with Comparative Example 2. Almost theoretical improvement in sound pressure could be achieved.

In FIG. 6, the characteristic of Comparative Example 2 is the reference characteristic (ϕ0.16 round electric wire), and the sensitivity is 89.2 dB. In Example 1 of the invention, the regular square electric wire is used. The sectional area is 1.15 times, and the length of the circumference in section is 1.09 times with respect to the reference ϕ0.16, and the sensitivity is 89.7 dB. In Example 2 of the invention, the regular square electric wire is used. The sectional area is 1.23 times, and the length of the circumference in section is 1.17 times with respect to the reference ϕ0.16, and the sensitivity is 90.3 dB. In Example 3 of the invention, the regular square electric wire is used. The sectional area is 1.26 times, and the length of the circumference in section is 1.22 times with respect to the reference ϕ0.16, and the sensitivity is 92.0 dB. Conditions of sensitivity (output sound pressure level average at designated frequencies) are SPL average points at 300, 400, 500, and 600 Hz.

In Embodiment 1 of the invention, the coil wire of the invention was compared with a round wire in which the sectional area of the conductive part is the same as that in the invention. In Embodiment 2 of the invention, the coil wire of the invention was compared with a round wire of a circular sectional shape having a diameter, which is the same as the length of one side of a square wire as the base of creation of the invention. It was understood from Embodiments 1 and 2 that the invention produces more excellent results.

It should be understood that various alternatives to the embodiments of the invention described herein may be employed in practicing the invention. Thus, it is intended that the following claims define the scope of the invention and that methods and structures within the scope of these claims and their equivalents be covered thereby.

The entire disclosure of Japanese Patent Application No. 2003-384209 filed on Nov. 13, 2003 including the specification, claims, drawings and abstract is incorporated herein by reference in its entirety.

What is claimed is:

1. A wire for use in a coil, said wire having a square sectional shape, wherein chamfers are provided at four corners in the section of the square, and sectional area of said wire having the chamfers is at least 1.15 times as large as that of a circle having a diameter which is the same as the length of one side of said square.

2. A coil wire according to claim 1, wherein arc-shaped chamfers are provided at four corners in the section of the square, and length of the radius of an arc of said arc-shaped chamfer is set so that the sectional area of said wire having said chamfers is at least 1.15 times as large as that of a circle having a diameter which is the same as the length of one side of said square.

3. A wire for use in a coil, said wire having a square sectional shape, wherein chamfers are provided at four corners in the section of the square, and overall length of an outer circumference of the section of said wire having said chamfers is at least 1.09 times as long as circumference of a circle having a diameter which is the same as the length of one side of said square.

4. A coil wire according to claim 3, wherein arc-shaped chamfers are provided at four corners in the section of the square, and length of the radius of an arc of said arc-shaped chamfer is set so that overall length of an outer circumference of the section of said wire having said chamfers is at least 1.09 times as long as circumference of a circle having a diameter which is the same as the length of one side of said square.

5. A coil wire according to claims 1, wherein length of one side of said square is 1 mm or less.

6. A coil wire according to claims 2, wherein length of one side of said square is 1 mm or less.

7. A coil wire according to claims 3, wherein length of one side of said square is 1 mm or less.

8. A coil wire according to claims 4, wherein length of one side of said square is 1 mm or less.

* * * * *